US009217954B2

(12) United States Patent
Mo

(10) Patent No.: US 9,217,954 B2
(45) Date of Patent: Dec. 22, 2015

(54) SYSTEMS AND METHODS FOR IMPLEMENTING ADVANCED TONER DISPENSING AND EMPTYING OF TONER CARTRIDGE COMPONENTS IN IMAGE FORMING DEVICES

(71) Applicant: XEROX Corporation, Norwalk, CT (US)

(72) Inventor: Song-Feng Mo, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/279,349

(22) Filed: May 16, 2014

(65) Prior Publication Data

US 2015/0331358 A1 Nov. 19, 2015

(51) Int. Cl.
*G03G 15/08* (2006.01)

(52) U.S. Cl.
CPC ..... *G03G 15/0865* (2013.01)

(58) Field of Classification Search
CPC ..... G03G 15/0834; G03G 15/0877; G03G 2215/0685
See application file for complete search history.

(56) References Cited

U.S. PATENT DOCUMENTS

2005/0265738 A1* 12/2005 Ogata ..... 399/27
2009/0214229 A1* 8/2009 Joo et al. ..... 399/27

* cited by examiner

*Primary Examiner* — Sandra Brase
(74) *Attorney, Agent, or Firm* — Ronald E. Prass, Jr.; Prass LLP

(57) ABSTRACT

A system and method are provided for operating an image forming device in a first processor-controlled toner control operating mode to maintain a substantially constant dispense rate of toner material from a toner source or bottle. The disclosed systems and methods improve toner material dispensing from the toner source or bottle in the image forming device by transitioning to a second processor-controlled toner control operating mode as an amount of toner material in the toner source or bottle is determined to be in a depleted, or nearly-exhausted, state. The disclosed systems and methods compensate for a determined decrease in a toner dispense rate occurring as an amount of toner material remaining in the toner source or bottle is nearly depleted. One or more toner control parameters, including a pixel count gain, are modified in the second processor-controlled toner control operating mode.

16 Claims, 7 Drawing Sheets

SYSTEMS AND METHODS FOR IMPLEMENTING ADVANCED TONER DISPENSING AND EMPTYING OF TONER CARTRIDGE COMPONENTS IN IMAGE FORMING DEVICES

BACKGROUND

1. Field of the Disclosed Embodiments

This disclosure relates to systems and methods for facilitating more complete toner emptying from nearly-depleted toner bottles while maintaining image quality in toner-based image forming devices.

2. Related Art

Certain image forming devices use charged toner particles as the marking material for image forming on image receiving substrates. The term "toner" generally refers to a powder-like particle material used as the marking material in image forming devices such as xerographic image forming devices and photocopiers to form printed text and images on image receiving substrates.

Toner is typically packaged in containers of differing sizes, shapes and compositions. These containers are often injection or blow molded container products. The containers may be generically referred to as "toner cartridges" or "toner bottles." Toner cartridges or bottles are most often formed as closed containers in which the toner material is conveniently packaged for supply to customers and/or end users. The customers and/or end users need never interact directly with the toner material powder itself. The toner cartridges or bottles rather are customer replaceable consumables components that the customers or end-users install as complete customer replaceable units or CRUs in the image forming devices. The toner cartridges or bottles may be opened for access to the toner material by the image forming devices themselves once the toner cartridges or bottles are installed in the image forming devices.

Image forming devices today include monitoring capabilities for monitoring levels of all consumables, including toner material in one or more toner cartridges or bottles. Upon an indication that any consumable, including the toner material in a particular toner cartridge or bottle, is nearly exhausted, the prudent customer or end-user will procure a replacement consumable component, in this case a toner cartridge or bottle, to have it at the ready. In this manner, when the image forming device advises the customer or end-user that the toner material is nearly or actually exhausted, the customer or end user need only remove the exhausted consumable component as a unit and replace it with a fresh, full consumable component, e.g., toner cartridge or bottle. In the image forming devices, particularly office-sized image forming devices, it is important to not preemptively discard consumables packaging that may have available and usable consumable material still housed therein.

Conventionally, in charged toner-based electrostatographic and xerographic image forming devices including, for example, printer and/or copier systems, toner cartridges and/or bottles may have sensors mounted on, or otherwise associated with, them to detect if the toner cartridge or bottle is depleted or nearly empty, and/or to inform the customer or end-user of an operating status of the toner cartridge or bottle. The attached sensors may communicate with the data receiving components in the image forming device to produce the notifications. Notifications may be graduated such that for a near empty cartridge or bottle the customer or end-user may be informed to order a replacement toner cartridge or bottle, and for an empty cartridge or bottle the customer or end-user may be informed to replace the cartridge or bottle.

Because device volume in office-sized printing/coping systems is very high, and price pressure and competition in this market space is severe, any unit material cost savings, particularly with regard to consumables, may have a huge impact on sales and profits. In this regard, there is a trend toward eliminating the sensors that detect toner cartridge or bottle empty conditions and/or produce "replace" alerts. The current trend is toward replacing these sensors with certain comprehensive algorithms to accomplish the "detection" and alert functions. In this regard, a monitor of toner dispense rates and toner control parameters replaces actual affixed sensors and associated sensor reader systems in the image forming devices.

These toner used/toner remaining estimation methodologies tend to be conservative in order that users do not find themselves in a situation in which, for example, an image forming device is exhausted of a marking material particularly at a critical time in which the customer or end-user may require that the particular image forming device necessarily perform imaging operations. Customers and/or end-users can be particularly sensitive to non-alerted exhaustion of toner materials leading to customer and/or end-user dissatisfaction. Exhaustion of toner materials during imaging operations results in poor image quality for the remaining images as well as certain difficulties with downtime for the machine while additional marking materials, for example, are procured and installed.

An equally dissatisfying difficulty arises, however, when the toner used/toner remaining estimation methodologies are too conservative in that significant amounts of toner material may actually remain in the toner cartridge or bottle when a declared depleted or empty indication is provided to the customer or end-user. This condition may have significant impact on a business case in that customers and/or end-users may find themselves being forced to replace toner cartridges or bottles at a higher than necessary rate. When it is determined that a significant amount of toner material may remain in an indicated-exhausted toner cartridge or bottle, the customer and/or end-user may be equally dissatisfying and having to incur such waste.

For example, currently available methods are in the boundary of both mean and standard deviations for the business case of the products in the market, but may not generally meet line of business (LOB) requirements for next generation products due to competitions in the market.

SUMMARY OF DISCLOSED SUBJECT MATTER

A careful balance, therefore, is struck between (1) signaling customers and/or end-users of pending exhaustion of consumables prior to that exhaustion adversely affecting image quality and (2) understanding that a certain amount of usable consumable may remain in the consumable packaging at a point when the customer and/or end-user receives a signal to replace the consumable packaging. In a specific example, a pre-determination is made regarding that point at which a customer or end-user may be advised of exhaustion of toner in a toner bottle. As toner depletes below a certain value, image quality begins to be adversely affected. As such, the indication regarding the point at which a customer or end-user may be advised of exhaustion of the toner in the toner bottle is at a level higher than that certain value of toner material remaining that may adversely affect image quality. Unfortunately, there will remain an amount of usable toner in the toner bottle which then becomes waste. Over time, customers or end-users may be directed to replenish toner supplies, or to change toner bottles at an interval more frequent than is absolutely necessary based on a remaining availability of toner material in the toner bottles.

Based on the foregoing scenarios, it would be advantageous to provide a scheme by which to appropriately alert the customer or end-user to a pending exhaustion of toner material while instituting methods by which to attempt to recover and/or deplete a larger percentage of the toner material from the toner bottle, leaving a significantly smaller amount of unused/unusable toner material as waste.

Exemplary embodiments of the systems and methods according to this disclosure may provide better and more robust sensor-less toner bottle level detection algorithms that may help to improve the system performance, increase customer and/or end-user satisfaction and generate more profit for the image forming device manufacturers and/or suppliers.

Exemplary embodiments may provide a scheme or strategy by which to maintain a level of image quality even as an amount of toner material remaining in a toner bottle is more effectively recovered and expended. In embodiments, the disclosed schemes may provide appropriate indications to a customer or end-user of pending bottle depletion while modifying a marking scheme to maintain image quality even as additional marking material, i.e., toner material, is further effectively depleted.

Exemplary embodiments may modify normal toner control algorithms, and employ a toner control error as a surrogate of the toner dispense rate drop during a last stage of toner bottle depletion, which may adjust a pixel count toner control gain as toner control drop occurs to reduce a toner control drop rate in the image forming device when only small amounts of toner material are left in the toner bottle. In embodiments, an objective is to guarantee that a minimal amount of toner material may be left in the toner bottle when that toner bottle may be declared empty.

Exemplary embodiments may institute a new scheme without requiring any sensors by which to determine an actual usable amount of toner material remaining in the toner bottle.

Exemplary embodiments may delay a degradation in image quality based on a nearly depleted or exhausted condition of the toner bottle that conventionally would adversely affect image quality.

Exemplary embodiments may modify a toner control algorithm in an image forming device to increase gains in levels of toner material transport from a toner bottle as the toner bottle approaches a depleted and/or exhausted condition.

Exemplary embodiments may monitor a dispense rate of toner material from a toner bottle and introduce enhanced toner control in response to a sensed condition that a dispense rate of toner from the toner bottle operatively decreases.

Exemplary embodiments may increase a dispense time control to adjust for a decrease in a dispense rate of toner from the toner bottle. In embodiments, the disclosed scheme may maintain image quality for an extended period by ensuring that a consistent toner mass is provided to the marking engine even as a toner dispense rate falls off based on a depleted and/or near exhausted condition for toner in the toner bottle. In embodiments, this scheme may delay reduction in image qualities, by adjusting gains to maintain a total toner mass under a toner control methodology that accounts for a sensed drop-off in toner dispense rate.

Exemplary embodiments may operate the image forming device in a normal mode until an actual, sensed, estimated or otherwise determined reduction in a toner dispense rate occurs. At that point, an enhanced mode may be entered to maintain a level of toner delivery to the marking engine to maintain image quality even as the toner dispense rate continues to reduce. In embodiments, implementation of the disclosed schemes may result in significant increases in a number of high quality image documents being produced in the image forming device, e.g., hundreds of additional prints may be realized before replacement of the toner bottle is required.

These and other features, and advantages, of the disclosed systems and methods are described in, or apparent from, the following detailed description of various exemplary embodiments.

BRIEF DESCRIPTION OF THE DRAWINGS

Various exemplary embodiments of the disclosed systems and methods for facilitating more complete toner material emptying from nearly-depleted toner bottles while maintaining image quality in toner-based image forming devices according to this disclosure, will be described, in detail, with reference to the following drawings, in which.

DETAILED DESCRIPTION OF THE DISCLOSED EMBODIMENTS

The systems and methods for facilitating more complete toner emptying from nearly-depleted toner bottles while maintaining image quality in toner-based image forming devices according to this disclosure will generally refer to this specific utility for those systems and methods. Exemplary embodiments described and depicted in this disclosure should not be interpreted as being specifically limited to any particular configuration a toner bottle, cartridge or dispenser, including a plastic or injection molded bottle, cartridge or dispenser. It should be recognized that any advantageous use of the unique toner bottle depletion schemes for emptying of a powdered substance from a container employing devices and methods such as those discussed in detail in this disclosure is contemplated.

The systems and methods according to this disclosure will be described as being particularly adaptable to use with toner bottles that deliver powdered toner material as a marking material for image forming in image forming, printing and/or copying devices. These references are meant to be illustrative only in providing a single real-world utility for the disclosed systems and methods, and should not be considered as limiting the disclosed systems and methods to any particular product or to any particular type of device in which such a product may be used. Any commonly-known processor-controlled image forming device in which the processor directs delivery of toner material that includes systems and dispenser configurations that may be adapted according to the specific capabilities discussed in this disclosure is contemplated.

Figure 1:
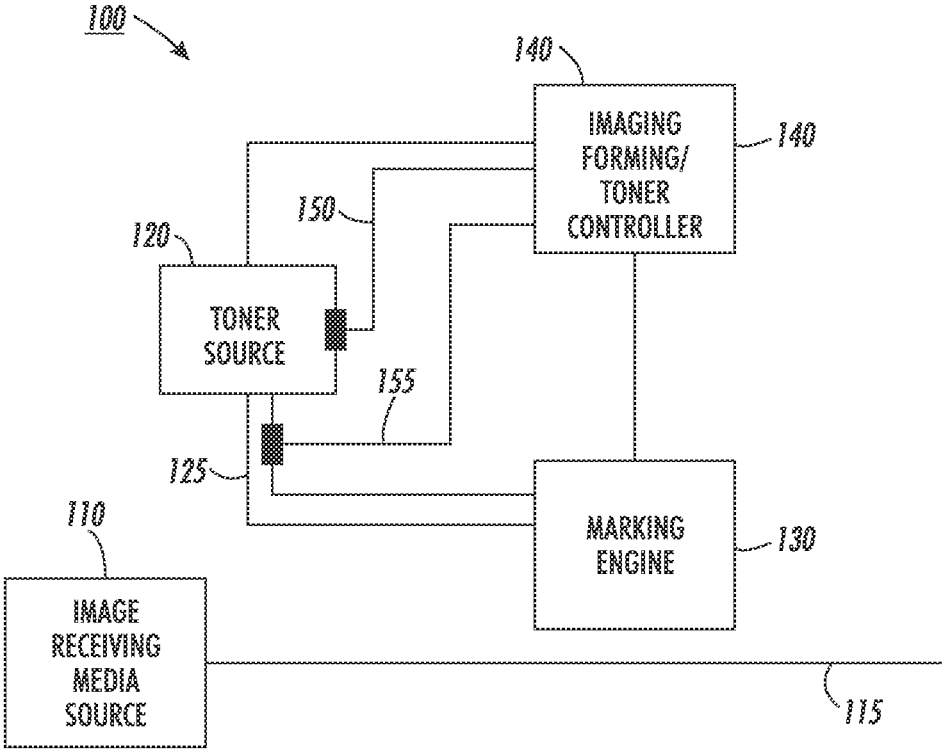
FIG. 1 illustrates a block diagram of an image forming system with improved toner bottle emptying according to this disclosure.

FIG. 1 illustrates a block diagram of an image forming system 100 with improved toner bottle emptying according to this disclosure. As shown in FIG. 1, the image forming system 100 may generally include an image receiving media source 110 that supplies a substrate of image receiving media in some form to a transport path 115. The transport path 115 is usable to present the substrates of image receiving media to the marking engine 130. The marking engine 130 may be of any conventional configuration for delivering toner material as the image marking material onto the substrates of image receiving media.

The toner material may be supplied to the marking engine 130 from a toner source 120 that may be configured as one of a toner cartridge or toner bottle, and may be further configured as a sealed customer replaceable unit. The toner material may be transported from the toner source 120 to the marking engine 130 via some material flow path 125. In certain configurations one or more sensors 150,155 may be provided to sense parameters of toner material levels and/or toner dispense rate in the image forming system 100. As discussed above, there have been implemented certain algorithms based estimations undertaken by one or more processes or control component in a typical image forming system to do away with any requirement for such one or more sensors 150, 155. In these systems, the processor or control component (controller) may reasonably accurately estimate a toner dispense rate required to achieve a certain pixel count in the image is formed by the marking engine 130 on the image receiving media substrates.

The image forming system 100 may include an image forming/toner controller 140 that may be operated in normal and enhanced modes of operation that will be described in greater detail below.

Those of skill in the art recognize that any toner control systems is intended to maintain a toner flow rate of the toner material from the toner bottle (source) at a particular value until the toner material is effectively depleted from the toner bottle. As a toner bottle nears being empty, a dispense rate of toner from that toner bottle will begin to fall off, thereby adversely affecting image quality. This adverse effect on image quality may be gradual at first and then ultimately fall off abruptly when the toner bottle is considered to be "almost" empty. A well-designed toner control system will maintain toner material flow at a particular rate within deviations as small as plus or minus, for example, one percent. As such, a first indication of toner material depletion may generally occur with a sensing of a drop-off in toner material dispense rate below some predetermined threshold around a nominal value for toner dispense rate from the toner bottle for continuous operations of the marking engine in the image forming device.

A typical parameter that is employed to determine whether toner control is maintained may be pixel count. At a point where pixel count begins to exceed a reasonable rate of toner availability based on the nominal toner dispense rate, a heightened awareness may be introduced with an increased gain scheme that effectively increases an amount of time for toner material to be dispensed from the toner bottle to account for a fall-off in a toner dispense rate from the toner bottle that is in a depleted or nearly exhausted condition. The disclosed schemes then may delay reduction in image quality until a point where significantly more toner material is scavenged from a depleted or nearly exhausted toner bottle. Put another way, the disclosed embodiments may significantly reduce an amount of toner material in a toner bottle when declared empty, and further reduce a standard deviation in the "sensed" parameters, in an effort to increase a yield of the toner bottle and profit.

Figure 2:
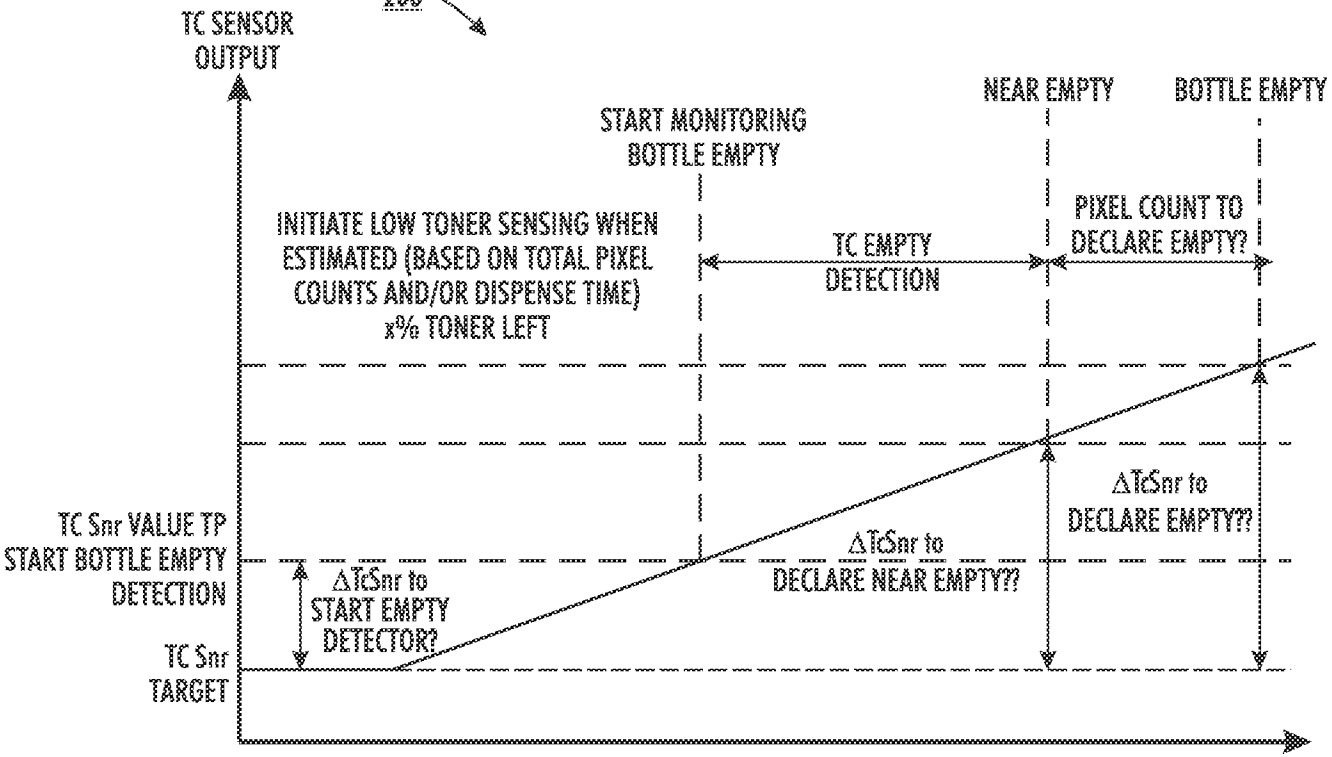
FIG. 2 Related Art
FIG. 2 illustrates a typical toner bottle empty detection process flow.

FIG. 2 illustrates a typical toner bottle empty detection process flow 200. As shown in FIG. 2, details of the process are as follows.

STEP 1—An accumulated dispense time (or pixel count) for the toner bottle may be estimated. When an estimate of the toner material left in the toner bottle is less than some predetermined amount, e.g., 15 percent, a bottle empty detection function may start running.

STEP 2—When a first toner control (TC) drop of a predetermined level, e.g., 0.5% TC, is determined, the process may declare the condition as perhaps a logic step "Start monitoring Bottle empty" by which a customer or end user may be advised to order a new toner bottle.

STEP 3—After the first TC drop is determined in STEP 2, another pre-determined set point may be established at, for example, about 1% TC. When this pre-determined set point is reached consistently, another logic step may declare a "Near Empty" level in order that the customer or end-user may be informed that there are only some pre-determined number, e.g., about 50 prints of nominal area coverage, for example, 5%, worth of toner material left in the toner bottle.

STEP 4—After a pre-defined pixel accumulation from the declaration of the "Near Empty" condition, the process may declare "Bottle Empty."

The above-described functioning of the process has been considered to be acceptable, for example, in meeting typical LOB requirements for current products in the market. It was determined through detailed experimentation, however, that there was room for certain improvement in the process. At the center of the experimentation, it was determined that there was an area for improvement if TC could be better controlled in the portion of the process after declaring "Start monitoring Bottle empty." In typical installations, relatively low cost direct current (DC) motors operate as a toner dispense mechanism, typically controlled only to be ON or OFF), not as step motors in which RPM may be regulated to better control toner dispensing. It is also known that in standard installations, a typical maximum rate for TC sensing may be on the order of intervals of seconds while a typical time interval between a toner material reaching a development housing and TC sensing may be on the order of about 10 to 30 seconds, often driven by processor capacities and system configurations. As such, gain and percentage contributions of TC sensor-based control cannot be too high, otherwise there will be significant TC oscillation even in a normal variable (nominal operating) area coverage printing run due to the large time delay. Through experimentation, it has been found that during the time period of bottle empty detection, toner dispense rate will drop to less and less toner material left in the toner bottle (see, e.g., FIGS. 3A and 3B below), but there is no conventional mechanism/sensor to directly measure the change of the toner dispense rate.

Figure 3A:
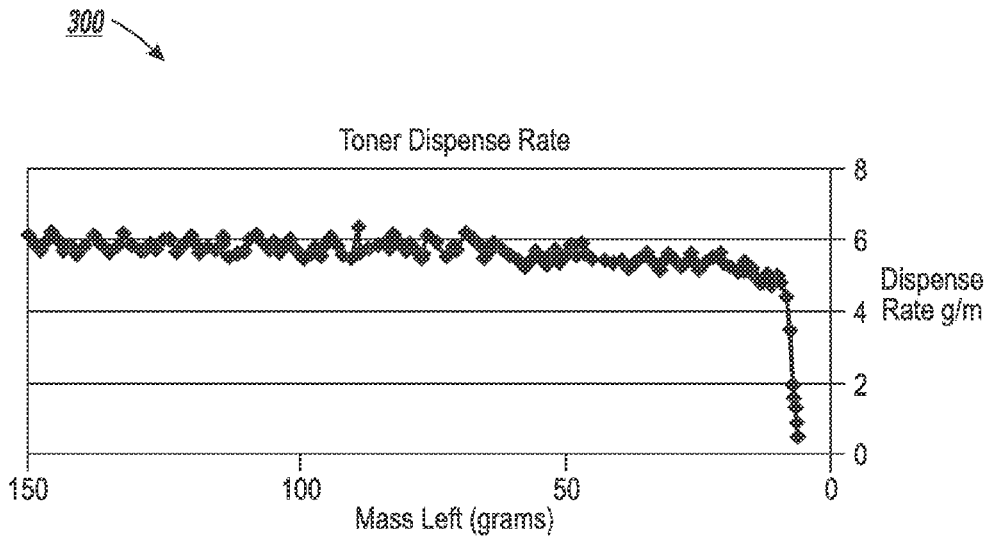
FIG. 3A Related Art
FIGS. 3A and 3B illustrate a model of a typical toner control drop off executing a typical bottle empty detection process flow as shown in FIG. 2.
Figure 3B:
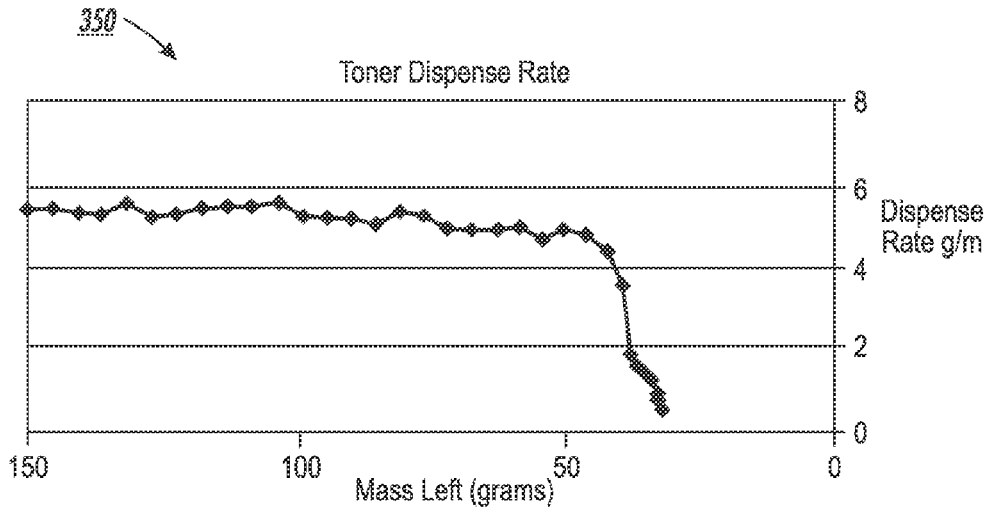
FIG. 3B Related Art

Toner dispense rate change may also adversely affect the performance of the bottle empty detection function. As shown in FIGS. 3A and 3B (elements 300 and 350), it can be seen that in a typical installation a toner dispense rate may start to drop when there may still be as much as 60 to 80 grams of toner material left in the toner bottle. The toner dispense rate may then drop by some more significant percentage (deep diving) when there may be as much as 15 to 20 grams of toner material left in the toner bottle. Tests indicate that these two points, especially the point where the deep diving commences, will vary from toner bottle to toner bottle, which makes it difficult to set fixed values for any modification in the system that carries into effect the process.

As discussed above, control contributions based on TC sensing are of limited effectiveness due to sensing delays and sensor accuracy. Typically, a maximum weighted contribution of a sensor-based TC control contribution may be set according to some pre-determined percentage of the total toner dispense of TC control in order that, when toner dispense rate drops by more than a determined percentage during the bottle near empty period, the TC control may not be able to keep up and maintain TC around the target level.

With an understanding of the above real phenomenon, further investigation indicated that TC error between a target value and a measured value may be used as surrogate of the toner dispense rate drop in the bottle near empty stage. This TC error information may be used to adjust a gain for a pixel count part of a TC controller to compensate for a toner dispense rate drop. Toner material could even be over dispensed from a pixel count part of the TC control to delay or slow down an increase of TC error or even maintain TC around the target for a longer time, i.e., delaying a point where toner dispense rate drops into the deep dive region. When properly set, a max pixel count gain at around a mid-point of the toner dispense rate deep dive region may afford the disclosed systems and methods to not only dispense more toner material out of a toner bottle when declared empty, but also may prevent the toner bottle from running out of toner before declaring the bottle empty.

According to the disclosed systems and methods, a typical toner control system may operate in a nominal mode across a broad expanse of its operating region as toner material is nominally dispensed at a particular toner dispense rate from a toner bottle (source). Upon actual sensing, estimation, or other determination of a triggering event such as, for example, the bottle empty monitoring state being set according to the above-described process, the typical toner control system may shift to an enhanced mode for improved toner material recovery from the toner bottle. A controller or processor in the toner control system may execute an algorithm that may be, for example, describable according to the following formula:

$$\text{PixelCountGain}=f(\text{DefaultPixelCountGain},\text{TCTarget},\text{TC Readings})$$

in which a pixel count gain may be a function of a default pixel count gain, a TC target, and certain TC readings. More specifically, one such enhanced operating function for TC control may be described as follows:

$$\text{PixelCountGain}=\text{DefaultPixelCountGain}+\text{BottleEmptyGain}*(\text{TCTarget}-\text{TC Readings})$$

where TC Readings may represent an average of a last particular number of TC sensor readings.

By employing an algorithm such as that represented briefly above as one example, the disclosed systems, methods and schemes implement improved toner bottle empty detection without sensors as follows.

STEP 1—An accumulated dispense time (or pixel count) for the toner bottle may be estimated. When an estimate of the toner material left in the toner bottle is less than some pre-determined amount, e.g., 15 percent, a bottle empty detection function may start running.

STEP 2—When a first TC drop of a pre-determined level, e.g., 0.5% TC, is determined consistently, i.e., continuous values are determined to be outside a pre-determined bottle empty detection range, the process may declare the condition to "Start Bottle empty monitoring" by which the customer or end-user may be advised to order a new toner bottle. At this point, the disclosed scheme may initiate a PixelCountGain adjustment process for TC control in an effort to maintain TC around a target, or to reduce a TC decreasing rate as long as possible, by employing an enhanced TC algorithm such as that outlined in exemplary manner above.

STEP 3—After the first TC drop is determined in STEP 2, another pre-determined set point may be established at, for example, about 1% TC. When this pre-determined set point is reached consistently, another logic step may declare a "Near Empty" level in order that the customer or end-user may be informed that there are only some nominal number, e.g., about 50 prints worth of toner material left in the toner bottle.

STEP 4—After a pre-defined pixel accumulation from the declaration of the "Near Empty" condition, the process may declare "Bottle Empty."

As such, the disclosed methodology seeks to establish consistent measurements outside pre-determined tolerances, to inform the customer and/or end-user, and to initiate a gain adjustment process for TC control.

Figure 4A:
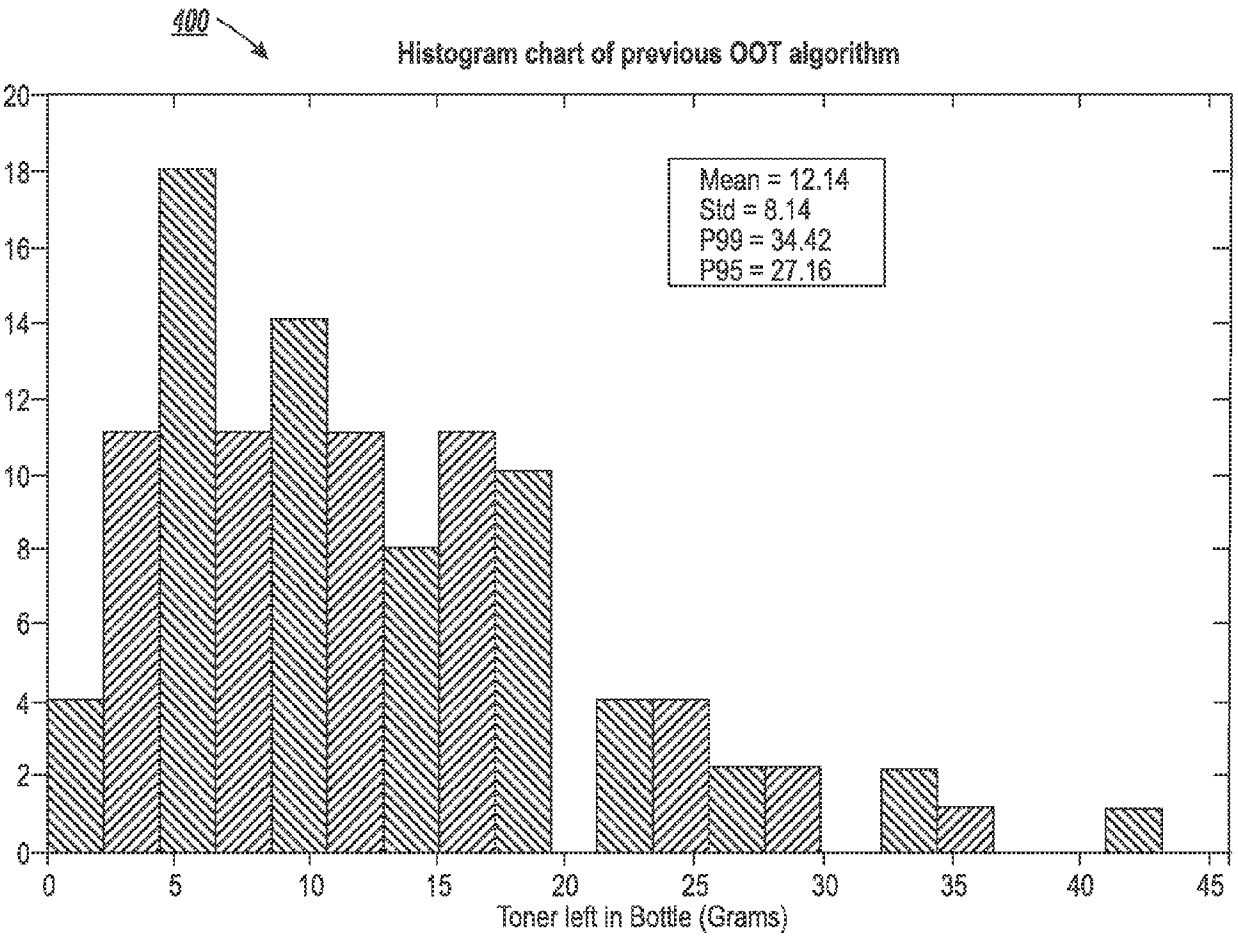
FIGS. 4A and 4B illustrate differential histograms for detection data in implementing a conventional TC algorithm and an advanced TC algorithm according to this disclosure.
Figure 4B:
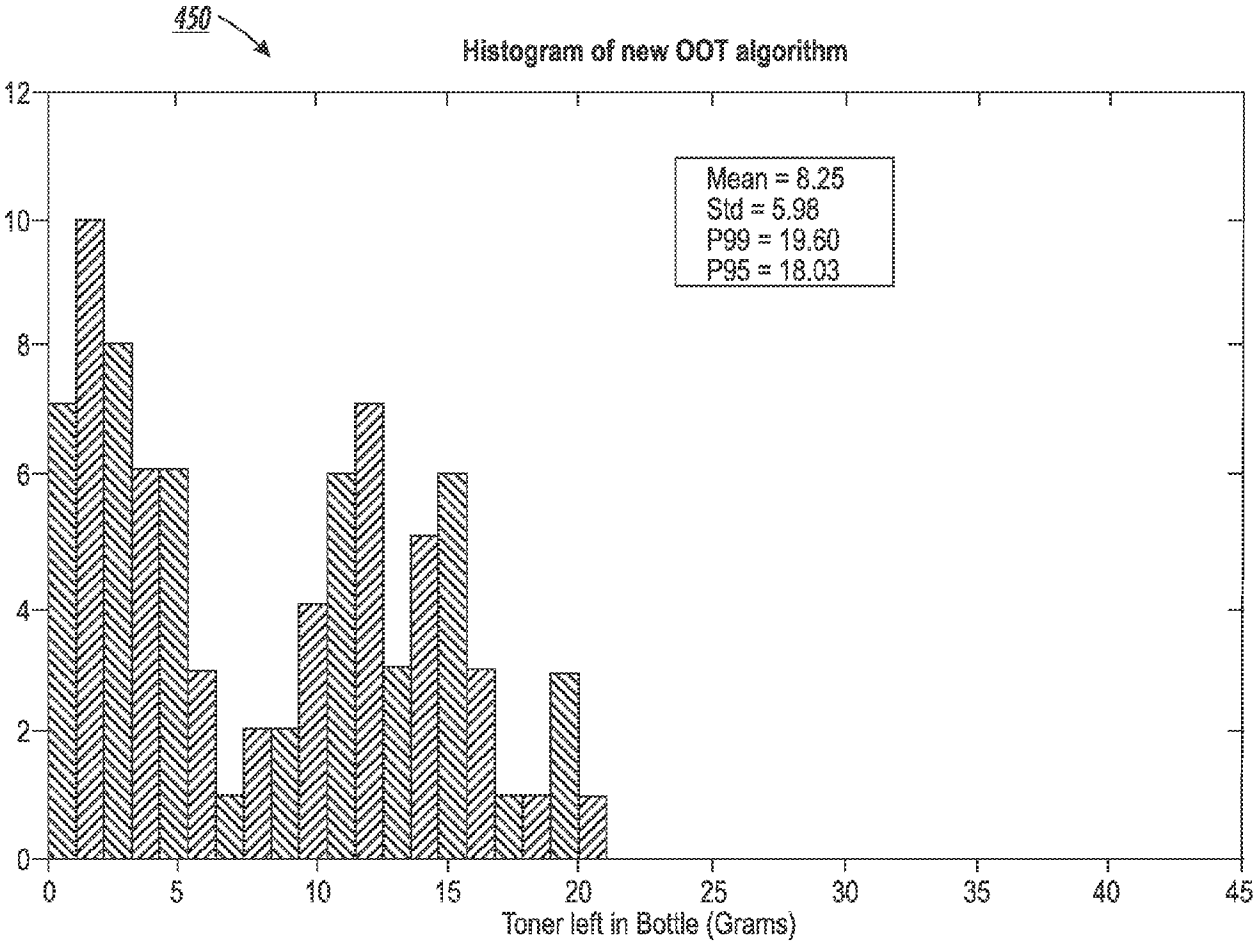

FIGS. 4A and 4B illustrate differential histograms 400,450 for experimental detection data in implementing a conventional TC algorithm and an advanced TC algorithm according to this disclosure. From the histogram plots 400,450 representing the statistic data shown in FIGS. 4A and 4B, it is clear that there is a significant performance improvement using the new algorithm (compare FIG. 4A, element 400 and 4B, element 450). Each of P99 and P95 is substantially reduced, e.g., from 34.42 grams and 27.16 grams, to 19.60 grams and 18.03 grams, respectively. An average and standard deviation are also shown to improve from 12.14 grams and 8.14, to 8.25 grams and 5.98, respectively.

Advantages that may be attributable to the disclosed scheme include the following. The disclosed schemes do not require a toner bottle empty sensor, thereby reducing the unit material cost (UMC) of the toner bottles without any reduction in capabilities. With a machine population estimated at several hundred thousand, an overall UMC saving can be significant. As compared to previous bottle empty algorithms and processes, test data indicates that the disclosed schemes may improve a yield of each toner bottle in a standard installation by approximately four grams. With an estimate of some number of prints/gram (standard default 5% area coverage) and a knowledge that a toner bottle should be usable to produce some approximate number of multiple thousands of prints, for example, each toner bottle may be expected to produce some additional significant number of prints worth of extra profit when the disclosed algorithms are applied. Also, statistic data shows that P99 of toner material left when the toner bottle empty condition is declared improve from 34.4 g to 19.6 g. Finally, the disclosed schemes may reduce a variation of toner material left in the toner bottle and make it easier to further optimize the parameters to have more consistent performance of the toner bottle empty detection.

Figure 5:
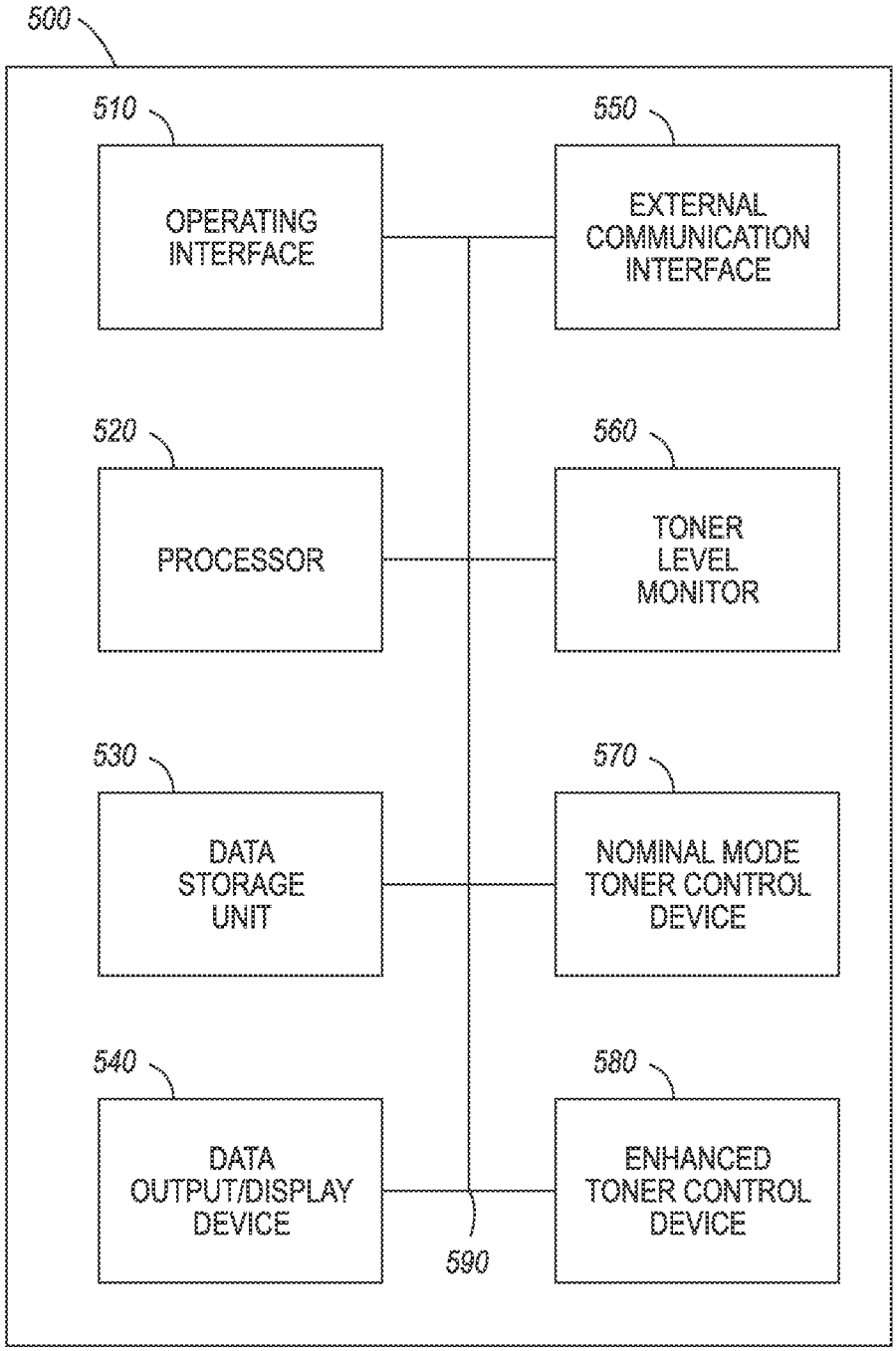
FIG. 5 illustrates a block diagram of an exemplary control system for implementing improved toner bottle emptying in an imaged forming device according to this disclosure.

FIG. 5 illustrates a block diagram of an exemplary control system 500 for implementing improved toner bottle emptying in an imaged forming device according to this disclosure.

The exemplary control system 500 may include an operating interface 510 by which a customer or end-user may communicate with the exemplary control system 500. The operating interface 510 may be a locally accessible user interface associated with an image forming device. The operating interface 510 may be configured as one or more conventional mechanisms common to control devices and/or computing devices that may permit a user to input information to the exemplary control system 500. The operating interface 510 may include, for example, a conventional keyboard, a touchscreen with "soft" buttons or with various components for use with a compatible stylus, a microphone by which a user may provide oral commands to the exemplary control system 500 to be "translated" by a voice recognition program, or other like device by which a user may communicate specific operating instructions to the exemplary control system 500. The operating interface 510 may be a part of a function of a graphical user interface (GUI) mounted on, integral to, or associated with, the image forming device with which the exemplary control system 500 is associated.

The exemplary control system 500 may include one or more local processors 520 for individually operating the exemplary control system 500 and for carrying out operating functions of an improved toner bottle depletion methodology in an image forming device with which the exemplary control system 500 may be associated. Processor(s) 520 may include at least one conventional processor or microprocessor that interprets and executes instructions to direct specific functioning of the exemplary control system 500.

The exemplary control system 500 may include one or more data storage devices 530. Such data storage device(s) 530 may be used to store data or operating programs to be used by the exemplary control system 500, and specifically the processor(s) 520. Data storage device(s) 530 may be used to store information regarding individual remaining toner schemes for, for example, alerting a user to potential or pending toner exhaustion in one or more toner bottles in an image forming device, as well as for implementing an automated scheme that may direct an enhance toner control scheme to facilitate scavenging of residual toner material in the toner bottle.

The data storage device(s) 530 may include a random access memory (RAM) or another type of dynamic storage device that is capable of storing updatable database information, and for separately storing instructions for execution of system operations by, for example, processor(s) 520. Data storage device(s) 530 may also include a read-only memory (ROM), which may include a conventional ROM device or another type of static storage device that stores static information and instructions for processor(s) 520. Further, the data storage device(s) 530 may be integral to the exemplary control system 500, or may be provided external to, and in wired or wireless communication with, the exemplary control system 500.

The exemplary control system 500 may include at least one data output/display device 540, which may be configured as one or more conventional mechanisms that output information to a user, including, but not limited to, a display screen on a GUI of the image forming device with which the exemplary control system 500 may be associated. The data output/display device 540 may be used to indicate to a customer or end-user a status of a supply of toner material in one or more toner bottles in the image forming device and also to advise the customer or end-user that the image forming device may be operating in a first (nominal) operating mode, or a second (enhanced) operating mode in view of an initial indication of a potential exhaustion condition for toner material in the one or more toner bottles.

The exemplary control system 500 may include one or more separate external communication interfaces 550 by which the exemplary control system 500 may communicate with components external to the exemplary control system 500. At least one of the external communication interfaces 550 may be configured as an output port to support connection to, and/or communication with, for example, an image forming device with which the exemplary control system 500 may be associated. Any suitable data connection in wired or wireless communication with an external data repository or external data storage device is contemplated to be encompassed by the depicted external communication interface 550.

The exemplary control system 500 may include at least one toner level monitor 560. The toner level monitor 560 may be associated with sensors in the image forming system, or preferably may be a processing algorithm in the exemplary control system 500 that assesses a toner level remaining in one or more toner bottles based on a monitoring of the image forming operations conducted by the image forming device since a last replacement of the one or more toner bottles. The toner level monitor 560 may operate as a part of a processor 520 coupled to, for example, one or more data storage devices 530, or as a separate stand-alone component module or circuit in the exemplary control system 500. The toner level monitor 560 may provide input to the exemplary control system 500 to advise the customer or end-user of a near exhausted condition of a toner level in the one or more toner bottles. The toner level monitor 560 may send a signal to the data output display device 540 to advise a user that certain action should be taken regarding, for example, replenishment of toner material in the one or more exhausted toner bottles.

The toner level monitor 560 may inform the exemplary control system 500 to select between a first nominal mode toner control device 570 and a second enhanced mode toner control device 580 to execute the improved toner depletion scheme according to the above discussion. Each of the first nominal mode toner control device 570 and the second enhanced mode toner control device 580 may operate as a part of a processor 520 coupled to, for example, one or more data storage devices 530, or as a separate stand-alone component module or circuit in the exemplary control system 500.

All of the various components of the exemplary control system 500, as depicted in FIG. 5, may be connected internally, and to one or more image forming devices by one or more data/control busses 590. These data/control busses 590 may provide wired or wireless communication between the various components of the exemplary control system 500, whether all of those components are housed integrally in, or are otherwise external and connected to an image forming device with which the exemplary control system 500 may be associated.

It should be appreciated that, although depicted in FIG. 5 as an integral unit, the various disclosed elements of the exemplary control system 500 may be arranged in any combination of sub-systems as individual components or combinations of components, integral to a single unit, or external to, and in wired or wireless communication with the single unit of the exemplary control system 500. In other words, no specific configuration as an integral unit or as a support unit is to be implied by the depiction in FIG. 5. Further, although depicted as individual units for ease of understanding of the details provided in this disclosure regarding the exemplary control system 500, it should be understood that the described functions of any of the individually-depicted components may be undertaken, for example, by one or more processors 520 connected to, and in communication with, one or more data storage device(s) 530.

Figure 6:
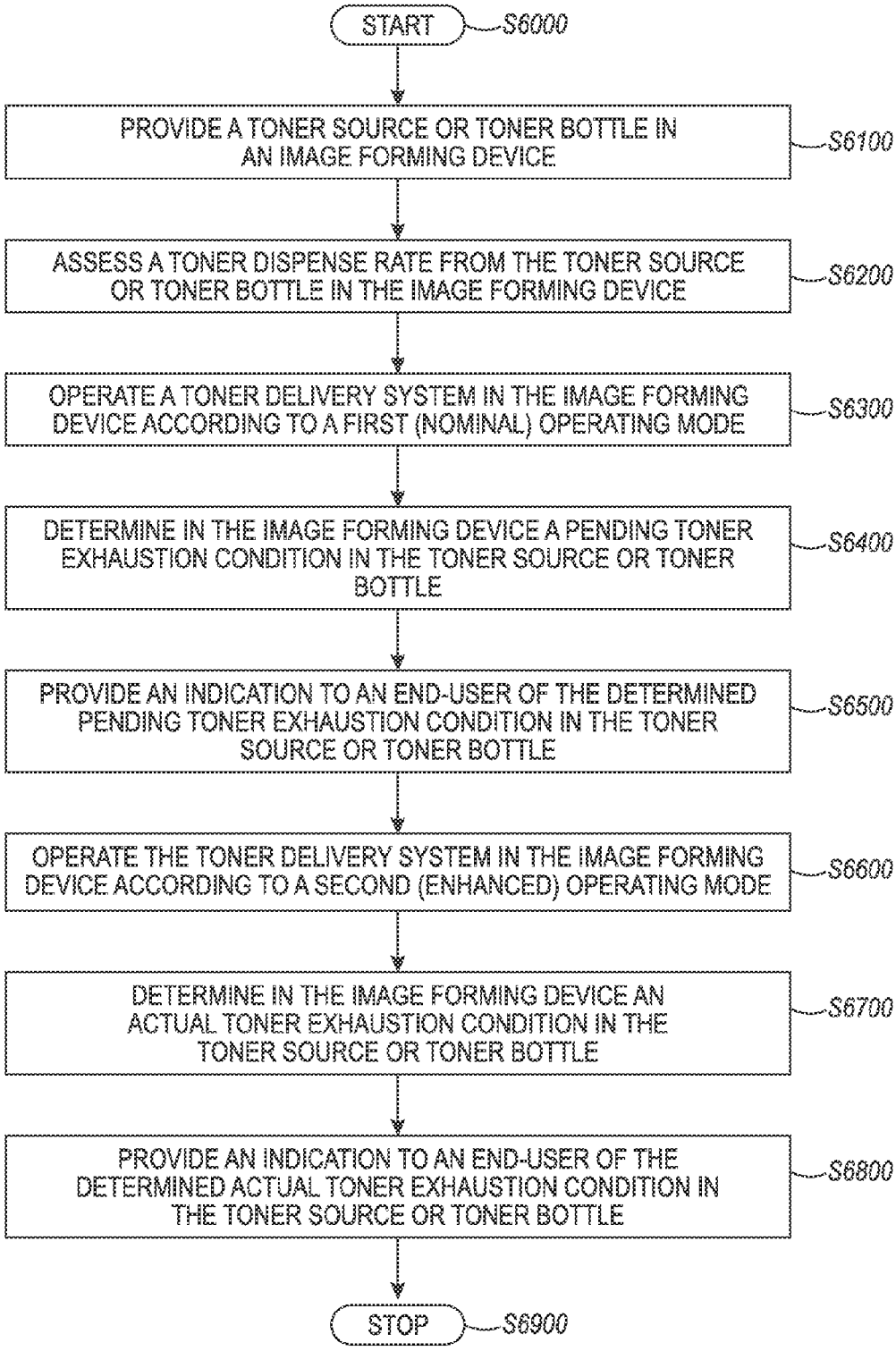
FIG. 6 illustrates a flowchart of an exemplary method for implementing improved toner bottle emptying in an image forming device according to this disclosure.

The disclosed embodiments may include an exemplary method for implementing improved toner bottle emptying in an image forming device. FIG. 6 illustrates a flowchart of such an exemplary method. As shown in FIG. 6, operation of the method commences at Step S6000 and proceeds to Step S6100.

In Step S6100, a toner source or bottle may be provided in an image forming device. Operation of the method proceeds to Step S6200.

In Step S6200, a toner dispense rate from the toner source or toner bottle in the image forming device may be assessed. Operation of the method proceeds to Step S6300.

In Step S6300, a toner delivery system in the image forming device may be operated according to a first (nominal) operating mode. The first (nominal) operating mode may monitor a toner dispense rate according to a pre-determined value. Operation of the method proceeds to Step S6400.

In Step S6400, a pending toner exhaustion condition in the toner source or toner bottle in the image forming device may be determined according to the above discussion. Operation of the method proceeds to Step S6500.

In Step S6500, an indication may be provided to an end-user of the determined pending toner exhaustion condition in the toner source or toner bottle. Operation of the method proceeds to Step S6600.

In Step S6600, the toner delivery system in the image forming device may be operated according to a second (enhanced) operating mode. The second (enhanced) operating mode may monitor a toner dispense rate according to an augmented scheme, as described in detail above. Operation of the method proceeds to Step S6700.

In Step S6700, an actual toner exhaustion condition in the toner source or toner bottle in the image forming device may be determined according to the above discussion. Operation of the method proceeds to Step S6800.

In Step S6800, an indication may be provided to an end-user of the determined actual toner exhaustion condition in the toner source or toner bottle. Operation of the method proceeds to Step S6900, where operation of the method ceases.

As indicated above, the method may positively provide a previously unachievable level of actual exhaustion of substantially all of the toner in the toner source or toner bottle based on scheme by which other parameters may be modified to maintain image quality even as a level of toner material in the toner source or toner bottle may be depleted beyond a currently-achievable level.

The disclosed embodiments may include a non-transitory computer-readable medium storing instructions which, when executed by a processor, may cause the processor to execute all, or at least some, of the steps of the method outlined above.

The above-described exemplary systems and methods reference certain conventional components to provide a brief, general description of suitable operating and product processing environments in which the subject matter of this disclosure may be implemented for familiarity and ease of understanding. Physical components in this disclosure may be in the form or molded and injection molded structures. Although not required, embodiments of the disclosure may be provided, at least in part, in a form of hardware circuits, firmware, or software computer-executable instructions to carry out the specific functions described. These may include individual program modules executed by a processor.

Those skilled in the art will appreciate that other embodiments of the disclosed subject matter may be practiced in devices, including image forming devices, of many different configurations.

As indicated above, embodiments within the scope of this disclosure may include computer-readable media having stored computer-executable instructions or data structures that can be accessed, read and executed by one or more processors. Such computer-readable media can be any available media that can be accessed by a processor, general purpose or special purpose computer. By way of example, and not limitation, such computer-readable media can comprise RAM, ROM, EEPROM, CD-ROM, flash drives, data memory cards or other analog or digital data storage device that can be used to carry or store desired program elements or steps in the form of accessible computer-executable instructions or data structures.

Computer-executable instructions include, for example, non-transitory instructions and data that can be executed and accessed respectively to cause a processor to perform certain of the above-specified functions, individually or in various combinations. Computer-executable instructions may also include program modules that are remotely stored for access and execution by a processor.

The exemplary depicted sequence of executable instructions or associated data structures represent one example of a corresponding sequence of acts for implementing the functions described in the steps of the above-outlined exemplary method. The exemplary depicted steps may be executed in any reasonable order to effect the objectives of the disclosed embodiments. No particular order to the disclosed steps of the method is necessarily implied by the depiction in FIG. 6, except where a particular method step is a necessary precondition to execution of any other method step.

Although the above description may contain specific details, they should not be construed as limiting the claims in any way. Other configurations of the described embodiments of the disclosed systems and methods are part of the scope of this disclosure.

It will be appreciated that various of the above-disclosed and other features and functions, or alternatives thereof, may be desirably combined into many other different systems or applications. Also, various alternatives, modifications, variations or improvements therein may be subsequently made by those skilled in the art which are also intended to be encompassed by the following claims.

I claim:

1. A system for transporting toner material in an image forming device, comprising:

a toner material source;

a marking engine that deposits toner material on an image receiving media substrate to form an image;

a transport path that delivers the toner material from the toner material source to the marking engine; and a toner material controller that operates the system in a plurality of operating modes, a first operating mode controlling the delivery of the toner material at a substantially constant dispense rate and a second operating mode compensating for a decrease in the substantially constant dispense rate as the toner material is depleted from the toner source, the toner material controller determining when the decrease in the substantially constant dispense rate for the toner material occurs, and the toner material controller modifying a time that the marking engine deposits the toner material on the image receiving media substrate to compensate for the decrease in the substantially constant dispense rate for the toner material.

2. The system of claim 1, the toner material controller determining when the decrease in the substantially constant dispense rate for the toner material occurs based on a determination that the decrease in the substantially constant dispense rate exceeds a first pre-determined threshold.

3. The system of claim 2, the toner material controller alerting a user that the toner source is depleted when the decrease in the substantially constant dispense rate exceeds a second pre-determined threshold, the second pre-determined threshold exceeding the first pre-determined threshold.

4. The system of claim 1, the toner material controller determining when the decrease in the substantially constant dispense rate for the toner material occurs without input from a sensor measuring toner material quantity remaining in the toner source.

5. The system of claim 1, the toner material controller determining when the decrease in the substantially constant dispense rate for the toner material occurs according to one or more toner control parameters.

6. The system of claim 5, at least one of the one or more toner control parameters being pixel count.

7. The system of claim 1, the toner material controller alerting a user that the toner material controller is operating the system in the second operating mode as an indication of the depletion of the toner material from the toner source.

8. A system for transporting toner material in an image forming device, comprising:

a toner material source;

a marking engine that deposits toner material on an image receiving media substrate to form an image;

a transport path that delivers the toner material from the toner material source to the marking engine; and a toner material controller that operates the system in a plurality of operating modes, a first operating mode controlling the delivery of the toner material at a substantially constant dispense rate and a second operating mode compensating for a decrease in the substantially constant dispense rate as the toner material is depleted from the toner source, the toner material controller determining when the decrease in the substantially constant dispense rate for the toner material occurs, the toner material controller determining when the decrease in the substantially constant dispense rate for the toner material occurs according to one or more toner control parameters, at least one of the one or more toner control parameters being pixel count, and the toner material controller modifying a pixel gain parameter for the marking engine depositing the toner material on the image receiving media in the second operating mode.

9. A method for transporting toner material in an image forming device, comprising:

providing a toner material in a toner material source;

providing a marking engine that deposits toner material on an image receiving media substrate to form an image;

delivering the toner material from the toner material source to the marking engine via a transport path according to a processor operating the image forming device in first operating mode controlling the delivery of the toner material at a substantially constant dispense rate;

determining, with the processor, that a decrease in the substantially constant dispense rate occurs as the toner material is depleted from the toner source; and compensating for the decrease in the substantially constant dispense rate by the processor operating image forming device in a second operating mode as the toner material is further depleted from the toner source, the processor modifying a time that the marking engine deposits the toner material on the image receiving media substrate to compensate for the decrease in the substantially constant dispense rate for the toner material.

10. The method of claim 9, the processor determining when the decrease in the substantially constant dispense rate for the toner material occurs based on a determination that the decrease in the substantially constant dispense rate exceeds a first pre-determined threshold.

11. The method of claim 10, the processor alerting a user that the toner source is depleted when the decrease in the substantially constant dispense rate exceeds a second pre-determined threshold, the second pre-determined threshold exceeding the first pre-determined threshold.

12. The method of claim 9, the processor determining when the decrease in the substantially constant dispense rate for the toner material occurs without input from a sensor measuring toner material quantity remaining in the toner source.

13. The method of claim 9, the processor determining when the decrease in the substantially constant dispense rate for the toner material occurs according to one or more toner control parameters.

14. The method of claim 13, at least one of the one or more toner control parameters being pixel count.

15. The method of claim 14, the processor modifying a pixel gain parameter for the marking engine depositing the toner material on the image receiving media in the second operating mode.

16. The method of claim 9, the processor alerting a user that the toner material controller is operating the system in the second operating mode as an indication of the depletion of the toner material from the toner source.

* * * * *